US008613410B2

(12) United States Patent
Bohlmann et al.

(10) Patent No.: US 8,613,410 B2
(45) Date of Patent: Dec. 24, 2013

(54) DEVICES FOR DETECTING THE OCCUPIED STATE OR THE FREE STATE OF A TRACK SECTION AND METHOD FOR OPERATING SUCH DEVICES

(75) Inventors: Peer Bohlmann, Schoenwalde (DE); Gerald Lude, Berlin (DE); Bernd Raschke, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 243 days.

(21) Appl. No.: 13/254,536

(22) PCT Filed: Feb. 23, 2010

(86) PCT No.: PCT/EP2010/052249

§ 371 (c)(1),
(2), (4) Date: Sep. 2, 2011

(87) PCT Pub. No.: WO2010/100055

PCT Pub. Date: Sep. 10, 2010

(65) Prior Publication Data

US 2011/0315828 A1 Dec. 29, 2011

(30) Foreign Application Priority Data

Mar. 2, 2009 (DE) ..... 10 2009 010 906

(51) Int. Cl.
*B61L 21/00* (2006.01)

(52) U.S. Cl.
USPC ..... 246/20; 246/122 R; 246/34 R

(58) Field of Classification Search
USPC ..... 246/20, 34 R, 122 R
See application file for complete search history.

(56) References Cited

U.S. PATENT DOCUMENTS

| | | | | |
|---|---|---|---|---|
| 7,017,864 | B2 | 3/2006 | McAllister | |
| 8,295,992 | B2 * | 10/2012 | Ecton et al. | 701/2 |
| 2003/0112131 | A1 | 6/2003 | McAllister | |

FOREIGN PATENT DOCUMENTS

| | | | |
|---|---|---|---|
| CN | 2758142 | Y | 2/2006 |
| DE | 2 147 773 | A1 | 3/1973 |
| DE | 2147773 | A1 | 3/1973 |

(Continued)

OTHER PUBLICATIONS

Gellerman, et al., "LZB 700—Die moderne Zugbeeinflussung mit Informationsübertragung über die Fahrschienen", Signal + Draht, Jun. 1992, pp. 158-164, vol. 84, No. 6, Telzlaff Verlag GmbH, Darmstadt, Germany.

(Continued)

*Primary Examiner* — Zachary Kuhfuss
(74) *Attorney, Agent, or Firm* — Laurence A. Greenberg; Werner H. Stemer; Ralph E. Locher

(57) ABSTRACT

A device detects an occupied state or a free state of a track section and has a transmitter for feeding a transmission signal in the form of an alternating voltage into the running rails of the track section and at least one receiver for receiving a reception signal which is brought about by a transmission of the transmission signal via the running rails of the track section. In order to be able to detect faults in the device, in particular cable faults, particularly reliably and at the same time cost-effectively, the device accordingly is configured to determine a phase shift between the transmission signal and the reception signal. A method for operating such a device is further disclosed.

12 Claims, 3 Drawing Sheets

(56) References Cited

FOREIGN PATENT DOCUMENTS

| | | | | |
|---|---|---|---|---|
| DE | 30 24 309 | A1 | 1/1982 | |
| DE | 3024309 | A1 | 1/1982 | |
| DE | 44 13 183 | A1 | 10/1995 | |
| DE | 4413183 | A1 | 10/1995 | |
| EP | 0 282 932 | A2 | 9/1988 | |
| EP | 0282932 | A2 | 9/1988 | |
| EP | 410117 | A2 * | 1/1991 | ..... B61L 1/18 |
| EP | 1 314 627 | A2 | 5/2003 | |
| EP | 1314627 | A2 | 5/2003 | |

OTHER PUBLICATIONS

Siemens, "FTG S Gleisfreimeldung mit dem Tonfrequenz-Gleisstromkreis FTG S", printed in Germany.

Hümmer, et al., "FTG S für die Gleisfreimeldung bei ausländischen Bahnen", Signal + Draht, Jul./Aug. 1989, pp. 158-163, vol. 81, No. 7/08, Telzlaff Verlag GmbH, Darmstadt, Germany (ISSN: 0037-4997).

LZB 700—Die moderne Zugbeeinflussung mit Informationsübertragung über die Fahrschienen, pp. 158-164, XP009081053, Germany. English abstract on last page.

Siemens AG: "FTG S Track Vacancy Detention wiht the FTG 5", pp. 1-5, Germany.

Huemmer, et al: "FTG S für die Gleisfreimeldung bei ausländischen Bahnen", XP000126826, Jul./Aug. 1989, pp. 158-163 , Germany. English abstract on p. 162.

International Search Report dated Jun. 29, 2010.

* cited by examiner

DEVICES FOR DETECTING THE OCCUPIED STATE OR THE FREE STATE OF A TRACK SECTION AND METHOD FOR OPERATING SUCH DEVICES

BACKGROUND OF THE INVENTION

Field of the Invention

The present invention relates to an apparatus for detection of the occupied or free state of a track section having a transmitter for feeding a transmitted signal in the form of an AC voltage into the rails of the track section and at least one receiver for receiving a received signal which is produced by transmission of the transmitted signal via the rails of the track section.

One such apparatus is known in the form of a track-free signaling device, in the form of a track circuit, for example from the company publication from Siemens AG "FTG S—Gleisfreimeldung mit dem Tonfrequenz-Gleisstromkreis FTG S" [FTG S—Track-free signaling using the FTG S audio-frequency track circuit], Order No. A19100-V100-B607-V2. In this case, a transmitter feeds an AC voltage into the rails of a track section to be monitored. A receiver receives a received signal in the form of the incoming voltage, and evaluates the received signal. Since a short circuit is produced between the rails of the track section by the axles of a rail vehicle which is traveling on the track section, this prevents the transmitted signal from being transmitted to the receiver. This therefore makes it possible to identify that the relevant track section is occupied.

In general, apparatuses for detection of the occupied or free state of a track section of the type mentioned initially are subject, for safety reasons, to the requirement of that, because of the dangers associated with this, an incorrect indication of a free state must not be produced in any circumstances.

Therefore, in order to avoid influences, for example, it is normally forbidden for transmitting and receiving lines of a track circuit to be carried within the same cable. Nevertheless, in principle, situations are feasible in which undesirable influences can occur between a transmitter and receiver, or between the respective lines to the rails.

This relates both to apparatuses having a transmitter and a receiver and, in particular, to those apparatuses which have a plurality of receivers, in general two or three. For example, in the course of monitoring switches or crossings by means of a single track circuit, there is therefore a requirement or a necessity to use a plurality of receivers. This also applies, for example, to the situation in which the transmitted signal is supplied to the track section by means of a so-called center feed, in which case one receiver is connected to each of the two ends of the track section. In apparatuses such as these having a plurality of receivers, disturbing influences can now also occur in particular in the situation in which the electrical lines of a plurality of receivers are carried within the same cable. In a situation such as this, it is necessary to ensure that an incorrect free message relating to a track section is reliably avoided even when a fault occurs, that is to say for example in the event of damage resulting in a short circuit to a cable or to one of the lines carried in the cable. For example, an incorrect free message such as this could occur by a short circuit resulting in the high level of a first received signal of a first receiver being coupled into the line of a second receiver, whose second received signal is at a low level because of occupancy.

BRIEF SUMMARY OF THE INVENTION

The present invention is based on the object of specifying an apparatus of the type mentioned initially in which faults, in particular apparatus-side cable faults, can be identified particularly reliably and at the same time cost-effectively.

According to the invention, this is object is achieved by an apparatus for detection of the occupied or free state of a track section having a transmitter for feeding a transmitted signal in the form of an AC voltage into the rails of the track section and at least one receiver for receiving a received signal which is produced by transmission of the transmitted signal via the rails of the track section, in which case the apparatus is designed to determine the phase shift between the transmitted signal and the received signal.

The apparatus according to the invention is advantageous because determination of the phase shift between the transmitted signal and the received signal allows reliable fault identification, in a simple manner. Therefore, there is a phase shift between the received signal and the transmitted signal, because the transmitted signal, which is fed into the rails of the track section, propagates in the form of the AC voltage. Since the path of the transmitted signal from the transmitter via the rails of the track section to the receiver is predetermined and fixed, the phase shift should no longer change once the apparatus and the track section have been configured. This makes it possible to immediately identify faults or defects in the apparatus on the basis of the phase shift between the transmitted signal and the received signal. By way of example, a phase shift of zero would therefore immediately indicate that the received signal has not been transmitted as intended via the rails of the track section, but, for example, has passed directly from the transmitter to the receiver.

If the apparatus has a plurality of receivers, it is advantageously possible to determine the phase shift between the transmitted signal and each individual one of the received signals.

Furthermore, the apparatus according to the invention is advantageous because the phase shift between the received signal and the transmitted signal can be evaluated independently of the processing and evaluation of the actual free message information. In particular, it is therefore possible to distinguish between a defect, for example in the form of a cable fault, and an occupied message resulting from an influence of axles. In this case, it should be remembered that the phase shift between the transmitted signal and the received signal means that a fault identification parameter is used, which is not used for the purposes of detection of the occupied or free state of the track section.

A further advantage is that, in contrast, to other feasible circuits for monitoring the cables or the lines in the cable or in the cables, scarcely any or no additional circuit parts are advantageously required, as a result of which the apparatus according to the invention can be implemented particularly cost-effectively. Because faults can be identified reliably it is also feasible to dispense with the requirement for transmitting lines and receiving lines to be routed separately, that is to say lines which lead from the track to the transmitter or receiver. A modification such as this, which is in principle made possible by the apparatus according to the invention, would lead to a considerable simplification of the wiring of the railroad monitoring system, in the form of the apparatus for detection of the occupied or free state of the track section.

Furthermore, according to the invention, the object on which the present invention is based is achieved by an apparatus for detection of the occupied or free state of a track section having a transmitter for feeding a transmitted signal in the form of an AC voltage into the rails of the track section and at least one receiver for receiving a received signal which is produced by transmission of the transmitted signal via the rails of the track section, in which, in an apparatus having a first receiver for receiving a first received signal which is produced by transmission of the transmitted signal via the rails of a first part of the track section, and having a second receiver for receiving a second received signal which is produced by transmission of the transmitted signal via the rails of a second part of the track section, the apparatus is designed to determine the phase shift between the first received signal and the second received signal.

In contrast to the first solution according to the invention to the object on which the invention is based, in the case of the second solution according to the invention, because the apparatus has a transmitter and at least two receivers, this advantageously makes it possible, in addition or as an alternative to the first solution according to the invention, to determine the phase shift between the first received signal and the second received signal, instead of comparing the phase shift between the transmitted signal and the respective received signal. This allows particularly efficient and simple fault monitoring of the apparatus, in particular for cable faults.

In this case, both solutions according to the invention are based on the same common idea, that the determination of the phase shift between the signals that are used makes it possible to identify discrepancies and/or disturbances or faults, in particular relating to the propagation path of the signals. The advantages of the further or second apparatus according to the invention therefore correspond substantially to the advantages already mentioned above in conjunction with the first apparatus according to the invention.

At this point, it should be noted in general that, with the two solutions according to the invention, there is no need for the transmitter and the at least one receiver of the apparatus to be arranged directly adjacent to the track. Said components and means for determining the phase shift between the respective signals, that is to say for example an appropriately designed evaluation device, are therefore associated in a preferred manner with the internal system, that is to say installed or accommodated by way of example in a signal box.

The apparatus according to the invention preferably continuously determines the phase shift between the respective signals. This advantageously ensures permanent functional monitoring of the respective apparatus. However, as an alternative to this, it is in principle also possible, for example, for the phase shift between the respective signals to be determined only while carrying out a functional test on the apparatus. A corresponding functional test could therefore be carried out, for example, every minute, every hour, or once a day, depending on the respective requirements.

It should also be noted that the apparatus according to the invention can be used particularly advantageously in conjunction with audio-frequency track circuits since, in this case, the signal which is used to detect the occupied or free state of the track section is already an AC voltage signal. However, in principle, it is also possible for the apparatuses according to the invention to be used in conjunction with those track circuits which operate at a signal frequency below or above the audible tone range, or else based on the direct-current principle. In the latter case, the transmitted signal in the form of the AC voltage is a signal which is superimposed on the direct current used for detection and is used exclusively for functional monitoring of the apparatus by determining the phase shift between this transmitted signal and the received signal, or between two received signals. In a situation such as this, an appropriate transmitted signal in the form of an AC voltage can either be permanently superimposed on the direct current or else can additionally be fed in, for example at predetermined time intervals only for functional testing.

According to one particularly preferred embodiment, the respective apparatus according to the invention is designed to compare the phase shift with at least one reference phase shift. This is advantageous since this allows the phase shift to be evaluated in a particularly simple manner. Thus, for example, before the apparatus is commissioned, the phase shift can be determined between the transmitted signal and the received signal when the apparatus for detection of the occupied or free state of the track section is serviceable, without any faults. This phase shift can then be stored, for example in a memory device for the apparatus, in the form of the reference phase shift, possibly taking account of tolerance values. Therefore, during subsequent operation of the apparatus, a fault can be identified immediately and unambiguously on the basis of a simple comparison of the phase shift with the reference phase shift, which has previously been determined in this way.

Independently of how a fault or a disturbance is identified in a specific case on the basis of the determined phase shift, the relevant, associated track section is preferably immediately signaled, as a precaution, as being occupied when a fault occurs, in order to avoid danger.

As an alternative to determining the reference phase shift before commissioning of the track-free signaling device in the form of the apparatus for detection of the occupied or free state of a track section, it would also be possible to monitor the phase shift between the received signal and the transmitted signal or between the first and the second received signals, for example by permanently comparing the instantaneous phase shift with a reference phase shift in the form of the most recently determined value of the phase shift. This also makes it possible to identify a change in the phase shift immediately and without any time delay.

The apparatuses according to the invention can also be developed in a preferred manner such that they are designed to produce a fault signal, which indicates a disturbance state, on the basis of the comparison between the phase shift and the reference phase shift. The fault signal therefore advantageously makes it possible, for example, to inform an operator in a signal box immediately of the presence of a fault situation.

A fault signal which indicates a disturbance state or fault and has been produced by the apparatus on the basis of the comparison between the phase shift and the reference phase shift can be output in various ways. In principle, it would be feasible, therefore, simply to make an appropriate entry in a log file. In a further particularly preferred embodiment, the respective apparatus according to the invention is designed to output the fault signal in the form of a visual and/or audible warning message. This advantageously means that the operator, that is to say for example the operator in a signal box, can be made aware of this in a particularly reliable manner.

According to one particularly preferred development of the apparatuses according to the invention, the transmitter is designed to feed a transmitted signal, which has been coded by means of modulation, into the rails of the track section, and the apparatus is designed to compare the modulation on the received signal or the modulation on at least one of the received signals with the modulation on the transmitted signal. In general, it is advantageous to use a transmitted signal which is coded by means of modulation, since this improves the insensitivity to disturbing influences. In this case, the association between the two signals is verified in a particularly simple manner by the comparison of the modulations on the received signal and on the transmitted signal. This is done without any need for rigid, fixed predetermined codings, permanently associated with the respective device, for example in the form of bit patterns, for this purpose. This also advantageously avoids the corresponding effort for configuration of the individual apparatuses, thus reducing the production costs of the apparatus. This also simplifies the assembly process, therefore additionally resulting in a time and cost saving. In addition, the configuration of a railroad monitoring system is also simplified, since no associations need be provided between codings or modulations and apparatuses, and there is therefore also no need to store corresponding associations on situation plans and data sheets, and to subsequently observe them. Furthermore, there are advantageously also no restrictions to the number and nature of the modulations used for coding, thus satisfying the precondition to making it possible to preclude multiple use of the same modulations within a system. In this context, the apparatus according to the invention can preferably be designed to produce a transmitted signal which is coded by means of any desired modulation, in particular generated on a random basis. If a discrepancy between the modulations is found when the modulation on the received signal is compared with the modulation on the transmitted signal, the track section associated with the apparatus is preferably immediately signaled as being occupied, in order to prevent danger.

The apparatuses according to the invention can also be developed in a preferred manner by designing the respective apparatus to transmit data signals via the rails of the track section to a rail vehicle which is occupying the track section. This is advantageous because this additionally allows the apparatus to be used for information transmission to a rail vehicle. By way of example, this also assists applications in the field of line train control. An appropriately developed apparatus can advantageously be used in such a way that the transmitter and receiver are linked to the respective trackside feed points, for example in the form of so-called track connection housings, such that either a transmitted signal from a transmitter can be selectively fed into the feed points, or a received signal can be read or received for a receiver. Such switching, which is known per se, is advantageous since data signals can be transmitted to a rail vehicle only for as long as the transmitter is located in front of the rail vehicle in the direction of travel. This is because shorting of the rails by the axles of the rail vehicle otherwise also prevents the transmission of data signals to a receiving device, which is normally arranged in the front area of a rail vehicle. In this context, it should be noted that the apparatuses according to the invention can also advantageously be used to determine in the same manner the phase shift between the transmitted signal and the received signal, or between the two received signals, independently of the direction of travel and the position of the rail vehicle in the track section.

Furthermore, the present invention relates to a method for operation of an apparatus for detection of the occupied or free state of a track section, in which a transmitted signal in the form of an AC voltage is fed into the rails of the track section, and a received signal which is produced by transmission of the transmitted signal via the rails of the track section is received.

With regard to the method, the present invention is based on the object of specifying a method for operation of an apparatus for detection of the occupied or free state of a track section, which allows faults, in particular apparatus-side cable faults, to be identified particularly reliably and at the same time cost-effectively.

According to the invention, this object is achieved by a method for operation of an apparatus for detection of the occupied or free state of a track section, wherein a transmitted signal in the form of an AC voltage is fed into the rails of the track section, and a received signal which is produced by transmission of the transmitted signal via the rails of the track section is received, and the phase shift between the received signal and the transmitted signal is determined.

Furthermore, the object on which the method according to the invention is based is also achieved, according to the invention, by a method for operation of an apparatus for detection of the occupied or free state of a track section, wherein a transmitted signal in the form of an AC voltage is fed into the rails of the track section, a first received signal which is produced by transmission of the transmitted signal via the rails of a first part of the track section is received, and a second received signal which is produced by transmission of the transmitted signal via the rails of a second part of the track section is received, and the phase shift between the first received signal and the second received signal is determined.

The advantages of the methods according to the invention correspond essentially to those of the apparatuses according to the invention, as a result of which reference is in this context made to the corresponding statements above. This also applies with regard to the developments of the methods according to the invention as mentioned in the following text, with respect to which reference is likewise made in a corresponding manner to the corresponding statements in conjunction with the respective preferred developments of the apparatuses according to the invention.

The methods according to the invention are preferably designed such that the phase shift is compared with at least one reference phase shift.

According to a further particularly preferred embodiment, the methods according to the invention are designed such that a fault signal, which indicates a disturbance state, is produced on the basis of the comparison between the phase shift and the reference phase shift.

The methods according to the invention can preferably also be carried out in such a way that the fault signal is output in the form of a visual and/or audible warning message.

The method according to the invention is advantageously designed such that a transmitted signal, which has been coded by means of modulation, is fed into the rails of the track section, and the modulation on the received signal or the modulation on at least one of the received signals is compared with the modulation on the transmitted signal.

According to a further particularly preferred development of the method according to the invention, data signals are transmitted via the rails of the track section to a rail vehicle which is occupying the track section.

The invention will be explained in more detail in the following text with reference to exemplary embodiments. In this case, in the figures:

DESCRIPTION OF THE INVENTION

For clarity reasons, the same reference symbols are used for the same components or components having the same effect in the figures.

Figure 1:
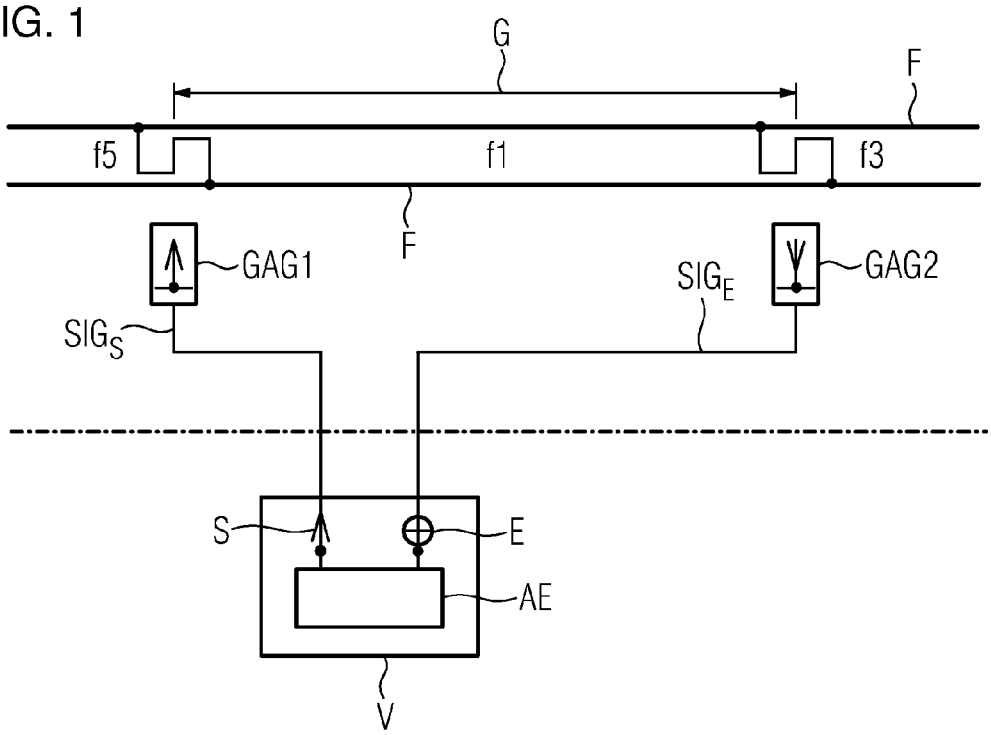
FIG. 1 shows a schematic sketch of an arrangement having a track section and first exemplary embodiment of the apparatus according to the invention with a transmitter and a receiver.

FIG. 1 shows a schematic sketch of an arrangement having a track section and a first exemplary embodiment of the apparatus according to the invention with a transmitter and a receiver. The illustration shows an apparatus V for detection of the occupied or free state of a track section G. The apparatus V has a transmitter S for feeding a transmitted signal $SIG_S$ in the form of an AC voltage into the rails F of the track section G. Furthermore, the apparatus V has a receiver E for receiving a received signal $SIG_E$ which is produced by transmission of the transmitted signal $SIG_S$ via the rails F of the track section G.

As shown in the illustration in FIG. 1, an AC voltage at the frequency f1 is fed into the track section G. In order to make it possible to reliably distinguish between the respective signals, the adjacent track sections are operated with an AC voltage at a different frequency f5 or f3. The following text assumes that the arrangement shown in the figure is an audio-frequency track circuit having a plurality of frequencies, in which an AC voltage in the form of a transmitted signal $SIG_S$ in the audio-frequency range is fed into the rails F of the track section G.

By way of example, the apparatus V can be arranged in a signal box of a railroad system, or a railroad monitoring system. This offers the advantage that particularly high reliability is achieved since mechanical stresses and climatic influences have less effect on the electronic components of the apparatus V than would be the case if these components were accommodated close to the track. Furthermore, this results in further advantages relating to the availability and maintenance of the apparatus V, that is to say, in particular of the transmitter S and of the receiver E. A corresponding separation between the internal system, which is associated with the apparatus V, and the external system, which is part of the track section G, is indicated by means of the horizontal dashed-dotted line in FIG. 1.

Corresponding to the illustration in FIG. 1, track connecting housings GAG1, GAG2 are arranged on the track side and are used to introduce the transmitted signal $SIG_S$, which is fed in or provided by the transmitter S, and to read the received signal $SIG_E$, which is transmitted to the receiver E, into and respectively out of the rails F. Normally, the track connecting housings GAG1, GAG2 in this case do not contain any active electronic components, but essentially only a resonant circuit for frequency-selective amplification of the signals which are fed in and out at a predetermined useful frequency, that is to say at the frequency f1 in the case of the track section G illustrated in FIG. 1.

In order to allow monitoring to be carried for disturbances and faults, in particular with respect to the cables and lines from the transmitter S to the track connecting housing GAG1 and from the track connecting housing GAG2 to the receiver E, the apparatus V also has an evaluation device AE, which is used to determine the phase shift between the transmitted signal $SIG_S$, which is transmitted by the transmitter S, and the received signal $SIG_E$, which is received by the receiver E. For this purpose, the evaluation device AE receives the transmitted signal $SIG_S$ from the transmitter S and the received signal $SIG_E$ from the receiver E and determines the phase shift, preferably based on safe signaling technology, between the two signals $SIG_S$, $SIG_E$. In this case, the apparatus V or the evaluation device AE is designed to compare the determined phase shift with at least one reference phase shift. The reference phase shift is preferably that value of the phase shift between the transmitted signal $SIG_S$ and the received signal as measured when there are no faults in the system.

Disturbances, for example resulting from crosstalk between the signals in adjacent track circuits, for example as a result of damage to an electrical line, can now advantageously be reliably detected from the comparison of the phase shift with the reference phase shift. When a corresponding fault is identified, the evaluation device AE in the apparatus V signals as a precaution that the track section G is occupied, and produces a fault signal which indicates the relevant disturbance state. For this purpose, the fault signal may, for example, be output in the form of a visual and/or audible warning message. In this case, a reliable distinction can be advantageously drawn between a disturbance, that is to say a cable fault, and a regular free or occupied message. Furthermore, determination of the phase shift and the comparison with the reference phase shift can advantageously be implemented with comparatively little complexity such that no or scarcely any additional circuit components are required, thus achieving a cost saving in comparison to other feasible solutions.

It should be stressed that the illustration in FIG. 1 is only a schematic illustration. For example, in practice, further components may be provided or required, which are not illustrated in FIG. 1 for clarity reasons. Thus for example, it is feasible for the apparatus V to additionally be designed to transmit data signals via the rails F of the track section G to a rail vehicle which is occupying the track section G. In this case, the transmitter S of the apparatus V advantageously has an external drive, by means of which the data signals can be supplied to the transmitter S.

Figure 2:
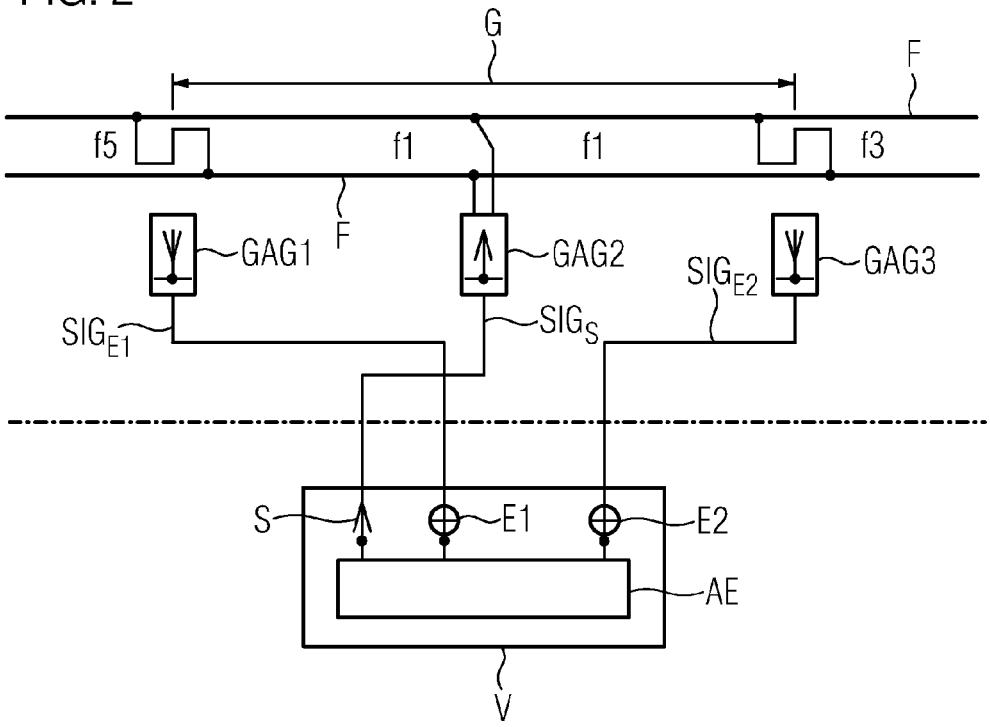
FIG. 2 shows a schematic sketch of an arrangement having a center-fed track section and a second exemplary embodiment of the apparatus according to the invention with a transmitter and two receivers.

FIG. 2 shows a schematic sketch of an arrangement having a center-fed track section and a second exemplary embodiment of the apparatus according to the invention with a transmitter and two receivers. In contrast to the illustration in FIG. 1, FIG. 2 therefore shows an arrangement with two receivers E1, E2. In this case, the respective received signal $SIG_{E1}$ or $SIG_{E2}$ is supplied to the receivers E1, E2 via the track connecting housings GAG1, GAG3. The first receiver E1 is used to receive the first received signal $SIG_{E1}$ which is produced by transmission of the transmitted signal $SIG_S$ via the rails F of the first part of the track section G, with the first part of the track section being formed by the track section between the track connecting housings GAG1 and GAG2. In a corresponding manner, the second receiver E2 is used to receive the second received signal $SIG_{E2}$ which is produced by transmission of the transmitted signal $SIG_S$ via the rails F of a second part of the track section G, which is formed by the track section between the track connecting housings GAG2 and GAG3.

The arrangement illustrated in FIG. 2 can on the one hand be used to monitor the serviceability of the apparatus V in the form of the track-free signaling device, by determining the phase shift between the transmitted signal $SIG_S$ of the transmitter S and the first received signal $SIG_{E1}$ of the receiver E1, and the phase shift between the transmitted signal $SIG_S$ and the second received signal $SIG_{E2}$ of the second receiver E2.

In addition or as an alternative to this, it is, however, also possible to determine the phase shift between the first received signal $SIG_{E1}$ of the receiver E1 and the second received signal $SIG_{E2}$ of the second receiver E2. The phase shift determined in this way also allows reliable identification of disturbances, in particular in the form of cable faults. This is particularly important in the case of an arrangement having one transmitter S and a plurality of receivers E1, E2, since, particularly in the situation in which the lines of a plurality of receivers E1, E2 are carried within one cable, disturbances can be caused by crosstalk or coupling in of a received signal into the line of another receiver. Disturbances and faults such as these are reliably identified by means of the evaluation device AE of the apparatus V, by the comparison of the phase between the transmitted signal $SIG_S$ and the respective received signals $SIG_{E1}$, $SIG_{E2}$, or between the received signals $SIG_{E1}$, $SIG_{E2}$, as a result of which faults or disturbances can also be excluded in the case of lines for a plurality of receivers E1, E2 which are carried in the same cable.

If the apparatus were to have more than two, that is to say by way of example three, receivers, then the phase shifts between the transmitted signal $SIG_S$ and the individual received signals could be determined analogously to the procedure described above, or else the phase shift of a combination or a plurality of combinations of the signals received by the receivers could be determined.

Figure 3:
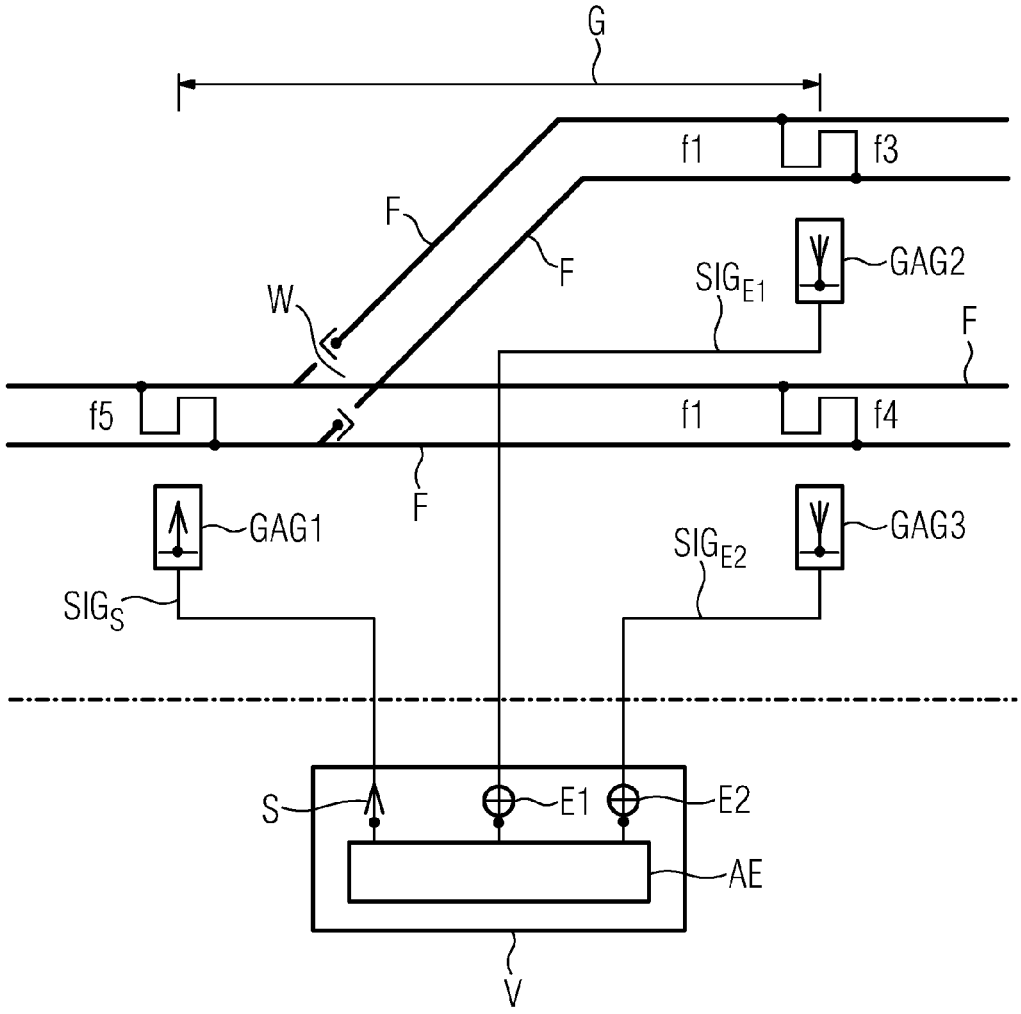
FIG. 3 shows a schematic sketch of an arrangement having a track section in the form of a switch and a third exemplary embodiment of the apparatus according to the invention with a transmitter and two receivers, and FIG. 4 uses a schematic illustration in the form of a graph with a transmitted signal and two received signals, in order to illustrate one exemplary embodiment of the method according to the invention.

FIG. 3 shows a schematic sketch of an arrangement having a track section in the form of a switch and a third exemplary embodiment of the apparatus according to the invention with one transmitter and two receivers. In a similar manner to the illustration in FIG. 2, this relates to an arrangement having an apparatus V with a transmitter S and two receivers E1, E2. In the illustrated case, this is a switch circuit, which is used for complete monitoring of a switch W.

Analogously to the procedure described in conjunction with FIG. 2, it is also possible in an arrangement such as this to reliably ensure, by determining the phase shift between the transmitted signal $SIG_S$ of the transmitter S and the respective received signals $SIG_{E1}$, $SIG_{E2}$ of the receivers E1, E2, or by determining the phase shift between the received signals $SIG_{E1}$, $SIG_{E2}$ of the first receiver E1 and the second receiver E2, that the received signals $SIG_{E1}$, $SIG_{E2}$ received by the respective receivers E1, E2 are also actually the respective uncorrupted received signal $SIG_{E1}$ or $SIG_{E2}$ as received or read out at the intended point on the track section G.

Figure 4:
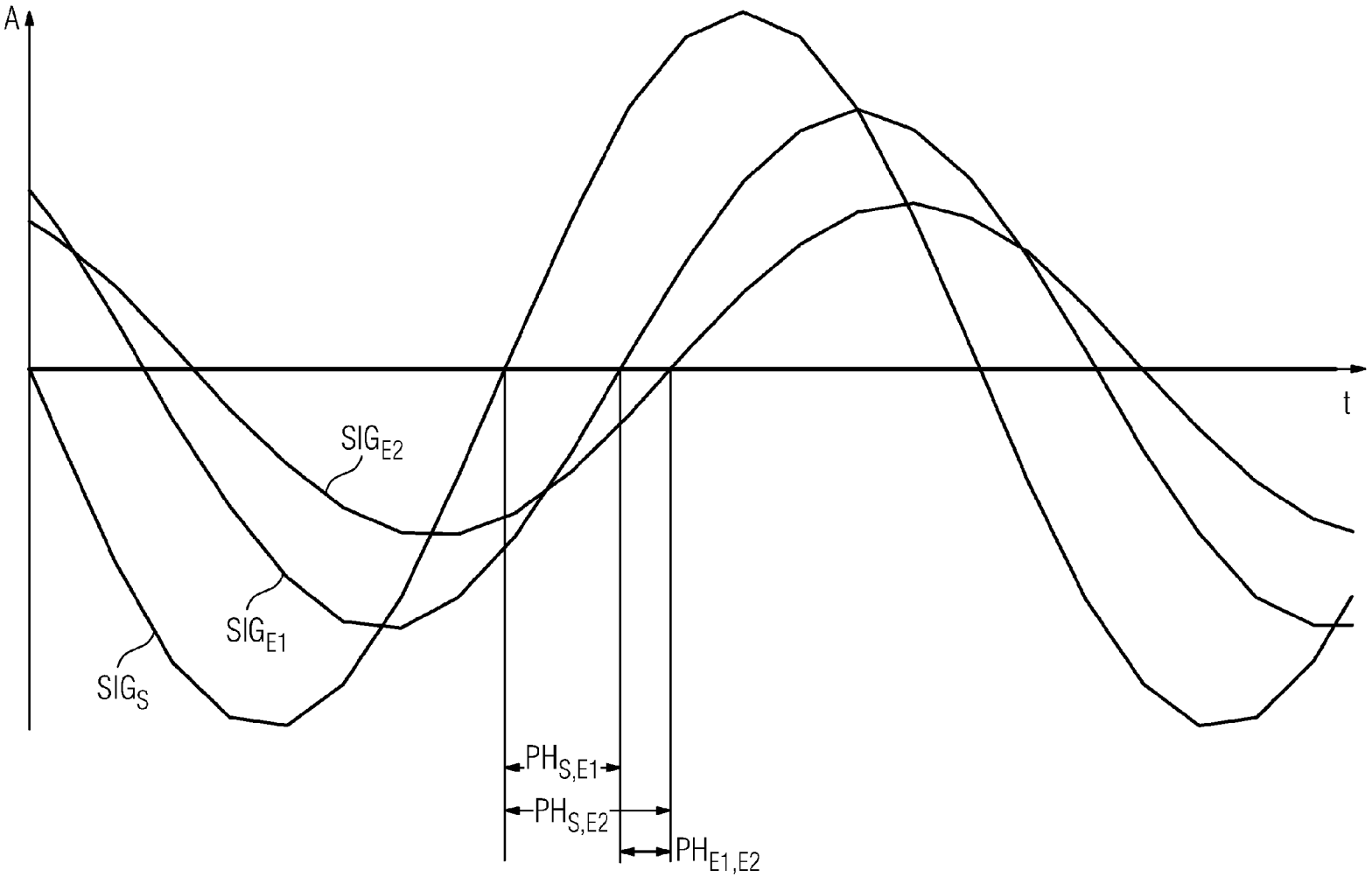

FIG. 4 uses a schematic illustration in the form of a graph with a transmitted signal and two received signals to illustrate one exemplary embodiment of the method according to the invention. The illustration in this case shows the amplitude A as a function of time t for a transmitted signal $SIG_S$, a first received signal $SIG_{E1}$ and a second received signal $SIG_{E2}$. As shown in the illustration in FIG. 4, the illustrated signals $SIG_S$, $SIG_{E1}$, $SIG_{E2}$ differ not only in terms of their amplitude A, but in particular also in terms of their phase.

The illustrated signals $SIG_S$, $SIG_{E1}$, $SIG_{E2}$ can therefore be either used as the basis for determining the phase shift $PH_{S,E1}$ between the transmitted signal $SIG_S$ and the first received signal $SIG_{E1}$, the phase shift $PH_{S,E2}$ between the transmitted signal $SIG_S$ and the second received signal $SIG_{E2}$, and/or the phase shift $PH_{S,E2}$ between the first received signal $SIG_{E1}$ and the second received signal $SIG_{E2}$. Evaluation of the phase shifts $PH_{S,E1}$, $PH_{S,E2}$, $PH_{E1,E2}$, for example by comparison with a respective corresponding reference phase shift, makes it possible to check the signal path of the respective received signals $SIG_{E1}$ or $SIG_{E2}$, or both received signals $SIG_{E1}$, $SIG_{E2}$. In this case, in particular, faults relating to the cables or lines between the track and the respective receiver can be identified in a corresponding manner to the above statements, thus advantageously, in particular, avoiding an incorrect free message, that is say an incorrect indication that the track section is free.

The invention claimed is:

1. An apparatus for detection of an occupied state or a free state of a track section, the apparatus comprising:

a transmitter for feeding a transmitted signal in a form of an AC voltage into rails of the track section; and receivers for receiving a received signal produced by transmission of the transmitted signal via the rails of the track section, said receivers including a first receiver for receiving a first received signal produced by the transmission of the transmitted signal via the rails of a first part of the track section, and a second receiver for receiving a second received signal produced by the transmission of the transmitted signal via the rails of a second part of the track section, the apparatus configured to determine a phase shift between the first received signal and the second received signal.

2. The apparatus according to claim 1, wherein the apparatus is configured to compare the phase shift with at least one reference phase shift.

3. The apparatus according to claim 2, wherein the apparatus is configured to produce a fault signal, which indicates a disturbance state, on a basis of a comparison between the phase shift and the reference phase shift.

4. The apparatus according to claim 3, wherein the apparatus is configured to output the fault signal in a form of a warning message selected from the group consisting of a visual warning message and an audible warning message.

5. The apparatus according to claim 1, wherein said transmitter is configured to feed the transmitted signal, which has been coded by means of modulation, into the rails of the track section, and the apparatus is configured to compare a modulation on at least one of the first or second received signals with a modulation on the transmitted signal.

6. The apparatus according to claim 1, wherein the apparatus is configured to transmit data signals via the rails of the track section to a rail vehicle which is occupying the track section.

7. A method for operation of an apparatus for detection of an occupied state or a free state of a track section, which comprises the steps of:

feeding a transmitted signal in a form of an AC voltage into rails of the track section;

receiving a first received signal produced by transmission of the transmitted signal via the rails of a first part of the track section;

receiving a second received signal produced by the transmission of the transmitted signal via the rails of a second part of the track section; and determining a phase shift between the first received signal and the second received signal.

8. The method according to claim 7, which further comprises comparing the phase shift with at least one reference phase shift.

9. The method according to claim 8, which further comprises producing a fault signal, which indicates a disturbance state, on a basis of a comparison between the phase shift and the reference phase shift.

10. The method according to claim 9, which further comprises outputting the fault signal in a form of a warning message selected from the group consisting of a visual warning message and an audible warning message.

11. The method according to claim 7, which further comprises:

feeding the transmitted signal, which has been coded by means of modulation, into the rails of the track section; and comparing a modulation on at least one of the first and second received signals with a modulation on the transmitted signal.

12. The method according to claim 7, which further comprises transmitting data signals via the rails of the track section to a rail vehicle which is occupying the track section.

* * * * *